US006118465A

United States Patent [19]

Arcaro et al.

[11] Patent Number: 6,118,465

[45] Date of Patent: Sep. 12, 2000

[54] SYNCHRONOUS BAND DRIVE FOR AN INLINE COLOR PRINTER

[75] Inventors: David J. Arcaro, Boise; Wayne E. Foote, Eagle; Kenneth E. Heath, Boise, all of Id.

[73] Assignee: Hewlett-Packard Company, Palo Alto, Calif.

[21] Appl. No.: 09/044,734

[22] Filed: Mar. 18, 1998

[51] Int. Cl.[7] ..... B41J 2/385

[52] U.S. Cl. ..... 347/153; 271/250; 271/252; 347/262; 347/264; 399/167; 399/388; 399/395

[58] Field of Search ..... 271/248, 250, 271/252; 347/153, 262, 264; 399/167, 301, 395, 388

[56] References Cited

U.S. PATENT DOCUMENTS 5,881,346 3/1999 Mori et al. ..... 399/301

5,887,230 3/1999 Sakamaki et al. ..... 399/167

FOREIGN PATENT DOCUMENTS 11024350 1/1999 Japan .

*Primary Examiner*—William Royer
*Assistant Examiner*—William A. Noe

[57] ABSTRACT

A single pass color printer employs a band drive to move media sheets through plural developer stations. The band drive also provides motive power to drive, in common (via frictional engagement with their respective peripheries), all of the organic photoconductor (OPC) rollers that are present in plural developer stations that are arrayed along the media movement path. The use of the common band drive assures that the surface speeds of the OPC drums and media sheets are synchronized at their respective points of contact, thus eliminating much of the station to station variations due to differences in diameters and runout of the plural OPC rollers.

10 Claims, 4 Drawing Sheets

SYNCHRONOUS BAND DRIVE FOR AN INLINE COLOR PRINTER

FIELD OF THE INVENTION

This invention relates to single pass multi-color laser printers and, more particularly, to a band drive mechanism for such a printer which enables improved alignment of color plane images.

BACKGROUND OF THE INVENTION

Difficulties in achieving precise color plane alignments have hindered development of multi-color laser printers which employ single pass color printing processes. Subimages derived from color image planes must be precisely positioned, relative to each other, or else substantial image degradation results. For example, a subimage misalignment that exceeds about 50 microns produces a detectable degradation in print quality.

A number of factors contribute to misalignment of subimages in single pass color printers. One such factor is the requirement to maintain precise alignment of the multiple imaging sources. A further factor which contributes to such misalignments is imperfections in the mechanisms which drive the media sheets through the print process. For instance, each single pass color printer employs at least three and generally four developer stations, each of which employs a developer roller and a transfer roller that, in combination, propel a media sheet through the developer station.

It is known that both developer rollers and transfer rollers may exhibit non-uniform run-outs (i.e., different degrees of out-of roundness). These run-outs will cause a media sheet to be driven at different rates through a developer station, especially since such rollers are center-driven. Further, the dimensions of such rollers are known to change as a result of temperature variations, roller handling, etc. When an in-line color printer includes more than one roller, any difference in run-out or diameter between the rollers can result in color plane image misalignment.

In pursuit of perfect registration of color plane images, printer manufacturers have attempted to build up the four color plane images on a well controlled substrate, prior to transferring the image to a media sheet. An example of such a substrate is a page-size photoconductor-coated drum wherein the four color plane images are sequentially deposited thereon. Other manufacturers have used a page size intermediate transfer medium to receive the four sequential images before transferring the full image to the media sheet. While these techniques have merit, they add considerable size and complexity to the color laser printer.

Accordingly, it is an object of this invention to provide an improved system for achieving subimage color plane alignment in a single pass, color printer.

It is another object of this invention to provide an improved system for subimage color plane alignment in a laser printer, wherein the color plane images are directly placed on the ultimate media sheet.

It is a further object of this invention to provide an improved system for achieving subimage color plane alignment in a single pass laser printer, wherein apparatus such as page-size image-receiving belts and drums are avoided.

SUMMARY OF THE INVENTION

A single pass color printer employs a band drive to move media sheets through plural developer stations. The band drive also provides motive power to drive, in common (via frictional engagement with their respective peripheries), all of the organic photoconductor (OPC) rollers that are present in plural developer stations that are arrayed along the media movement path. The use of the common band drive assures that the surface speeds of the OPC drums and media sheets are synchronized at their respective points of contact, thus eliminating much of the station to station variations due to differences in diameters and runout of the plural OPC rollers.

DETAILED DESCRIPTION OF THE INVENTION

Figure 1:
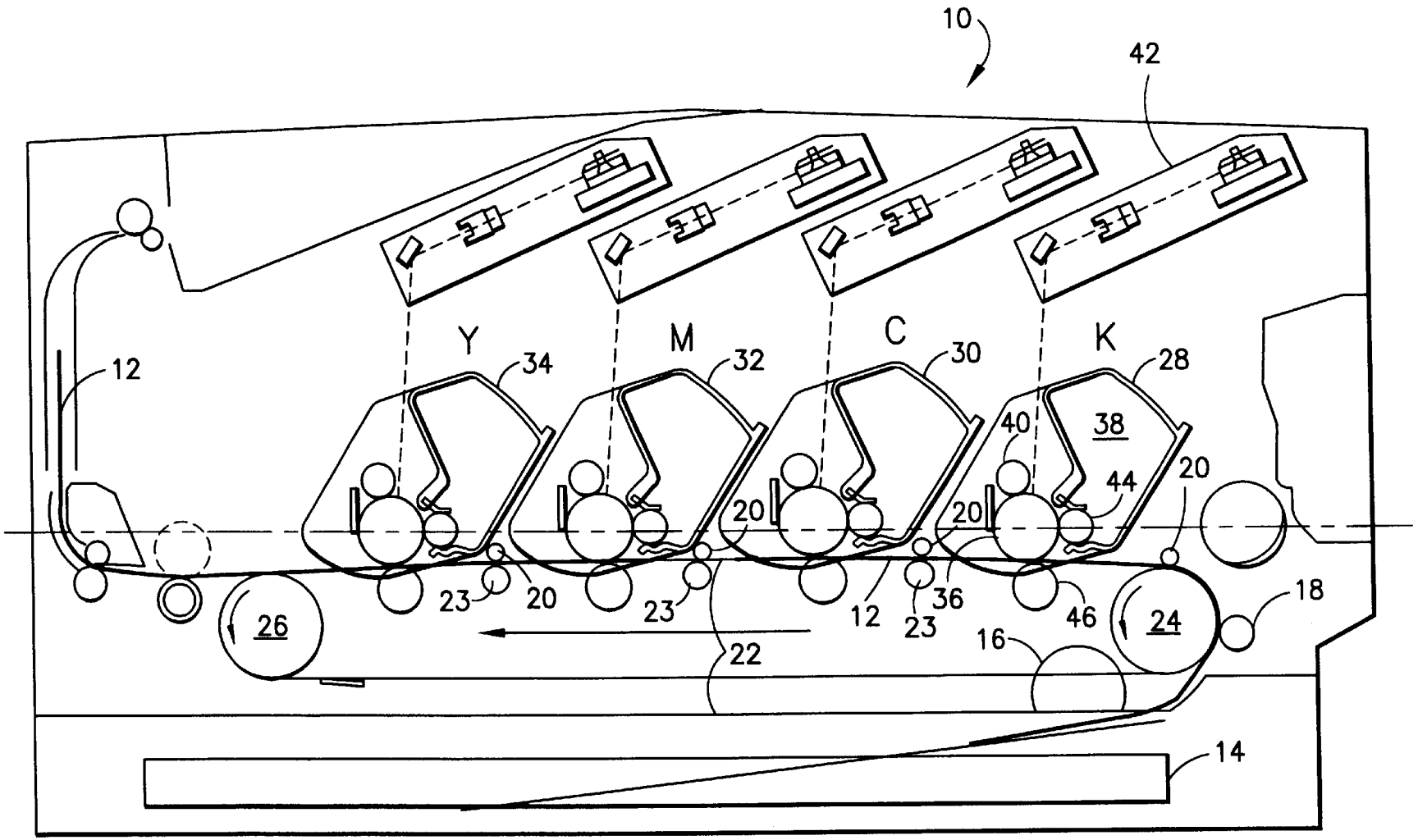
FIG. 1 is a schematic side sectional view of a full color laser print engine that incorporates the invention.

Referring to FIG. 1, print engine 10 incorporates apparatus for producing full color images on media sheets 12. Each media sheet 12 is selected from a media tray 14 by a pick roller 16 and is grabbed between a follower roller 18 and a media transport band 22 (which rides on follower pulley 24 and drive pulley 26, respectively). Media transport band 22 comprises at least one narrow band which grabs one side of a media sheet and propels it through a plurality of developer stations 28, 30, 32 and 34. A plurality of skew rollers 20 are positioned along media transport band 22 and act to move media sheets against a justifying edge along the media transport path (not shown in FIG. 1). Back-up rollers 23 force the media sheet against skew rollers 20 between each of developer stations 28, 30, 32 and 34.

Each of developer stations 28, 30, 32 and 34 is substantially identical, except that each contains a different color toner. For instance, developer station 28 includes black toner (K), developer station 30 includes cyan toner (C), developer station 32 includes magenta toner (M) and developer station 34 contains yellow toner (Y). Each developer station further includes an organic photoconductor (OPC) that is positioned on an OPC roller 36, also know as a photoreceptor roller. The toner supply for each developer station is maintained within a reservoir 38.

OPC roller 36 is contacted by a charge roller 40 which applies the necessary charge state to OPC roller 36. Thereafter, a laser scanner 42 is controlled to scan OPC roller 36 and to impart charge states thereon in accordance with a particular color plane image. In the case of developer station 28, laser scanner 42 is controlled by data from a black color plane.

As OPC roller 36 rotates the charged image, it passes by a developer roller 44 which, in the known manner, enables toner to be taken up onto the surface of OPC roller 36 in accordance with the charge states resident thereon. Thereafter, the toned image is rotated into contact with a media sheet 12 which is pressed against OPC roller 36 by a transfer roller 46. Each of the additional developer stations operates in a substantially identical manner, using an associated laser scanner.

Figure 2:
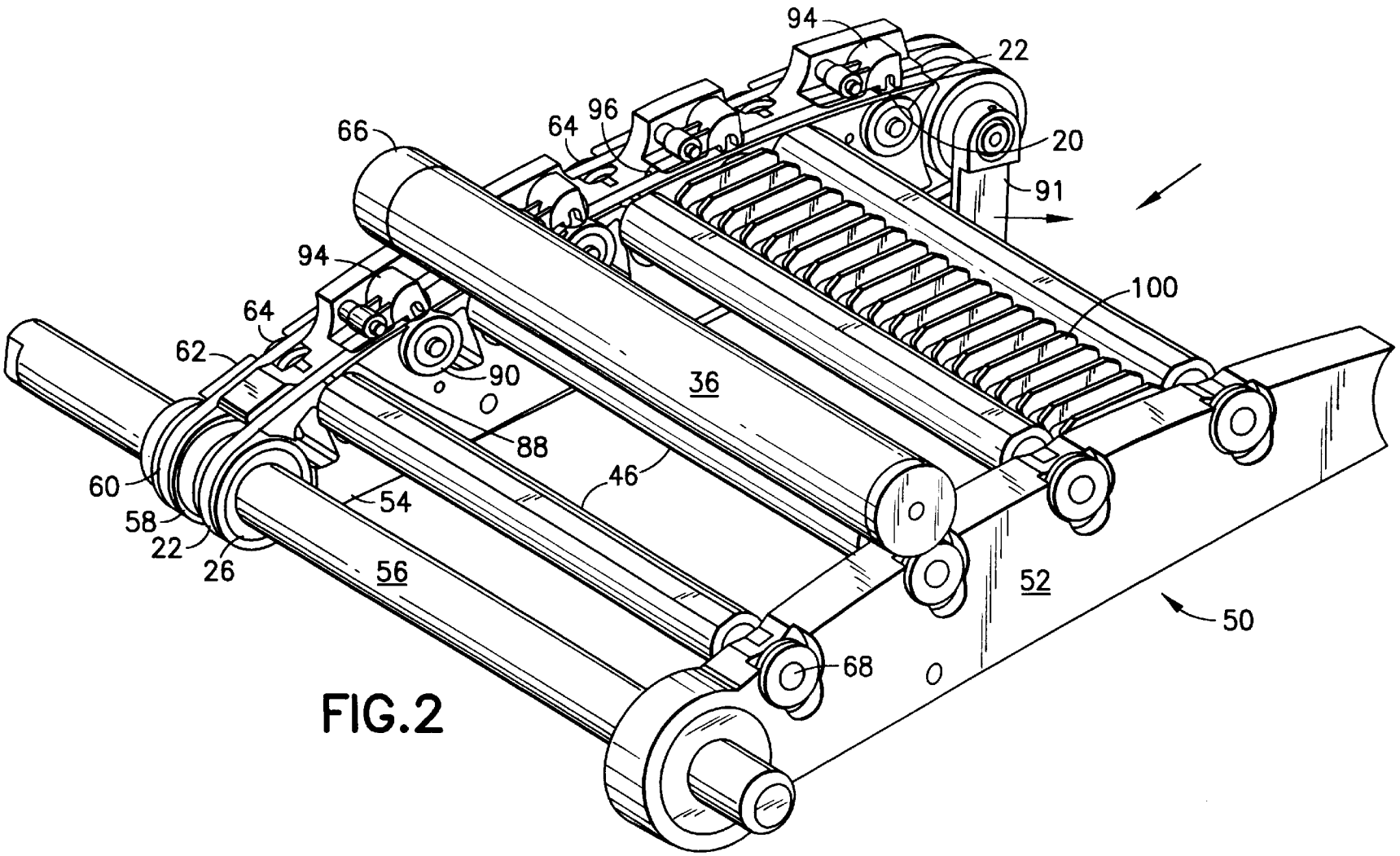
FIG. 2 is a perspective view of media transport apparatus used in the print engine of FIG. 1.

Referring now to FIG. 2, further structural details of print engine 10 will be described. It is to be understood that the perspective view of FIG. 2 only includes OPC roller 36 and transfer roller 46 from a selected developer station shown in Fig. 1. The remaining developer stations have been eliminated to enable the details of media sheet drive mechanism 50, that are hidden thereby, to be illustrated.

Media sheet drive mechanism 50 includes a right frame member 52 and the left frame member 54. A drive shaft 56 is journalled into right frame member 52 and left frame member 54 and provides the motive power for media sheet drive mechanism 50. A drive pulley 58 is affixed to drive shaft 56 and is driven thereby to impart drive motion to OPC drive band 60. OPC drive band 60 runs over a surface 62 on the outer edge of left frame member 54 and engages a pressure roller 64 at each developer station. OPC drive band 60 is tensioned by a follower pulley 61, shown in FIG. 1, which is tensioned to the right by a spring biased link (not shown).

Each pressure roller 64 is pressed upwardly so as to force OPC drive band 60 into driving engagement with an end 66 of a corresponding OPC roller 36. It is preferred that end 66 of each OPC roller 36 is covered with a high coefficient of friction material, e.g., an elastomeric material, to enable frictional engagement with OPC drive band 60.

Figure 4:
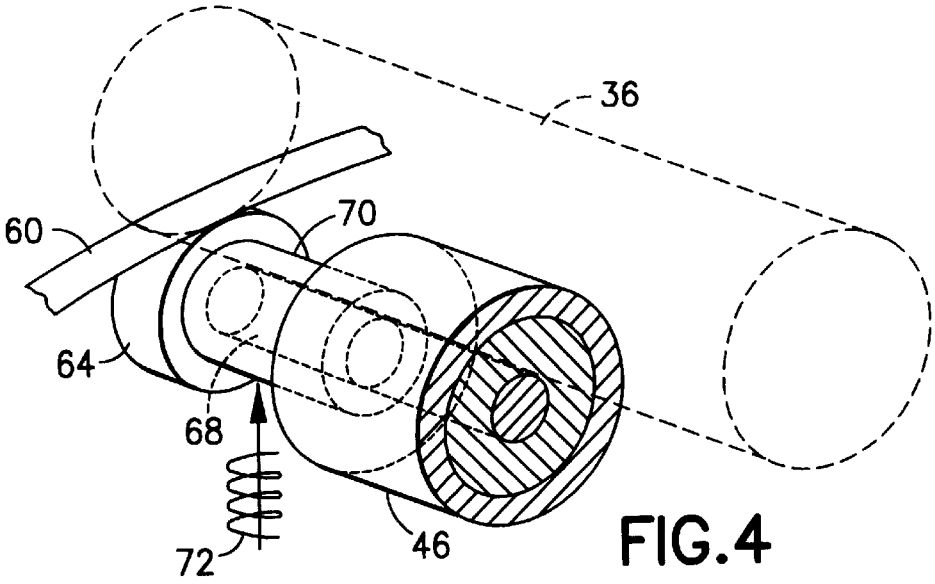
FIG. 4 is a partial perspective view of a first embodiment of an OPC drive band and a pressure roller that transfers drive power to both an OPC roller and a transfer roller.

In a first embodiment, pressure roller 64 and transfer roller 46 are mounted on a common shaft 68 so that the rotation of pressure roller 64 causes a like rotation of transfer roller 46. Further details of the connection between transfer roller 46 and pressure roller 64 are illustrated in FIG. 4. As can there be seen, shaft 68 extends from pressure roller 64 through transfer roller 46 in such a matter as to enable OPC drive band 60 to drive both pressure roller 64 and transfer roller 46. A bushing 70 is slidably mounted on shaft 68 and is biased upwardly by a spring mechanism 72 (shown schematically). In such manner, pressure roller 64 is biased against OPC drive band 60 which is, in turn biased against elastomeric layer 66 on OPC roller 36.

Further, spring mechanism 72 also biases transfer roller 46 against OPC roller 36 (shown schematically). A similar spring mechanism resides at the opposite end of transfer roller 46 so as to bias that end against OPC roller 36 (see FIG. 2). Accordingly, the movement of OPC drive band 60 causes rotary motion to be imparted to OPC roller 36 as a result of the frictional engagement with elastomeric layer 66 on OPC roller 36, and further causes rotation of transfer roller 46 as a result of the rotation of shaft 68 by pressure roller 64.

Figure 5:
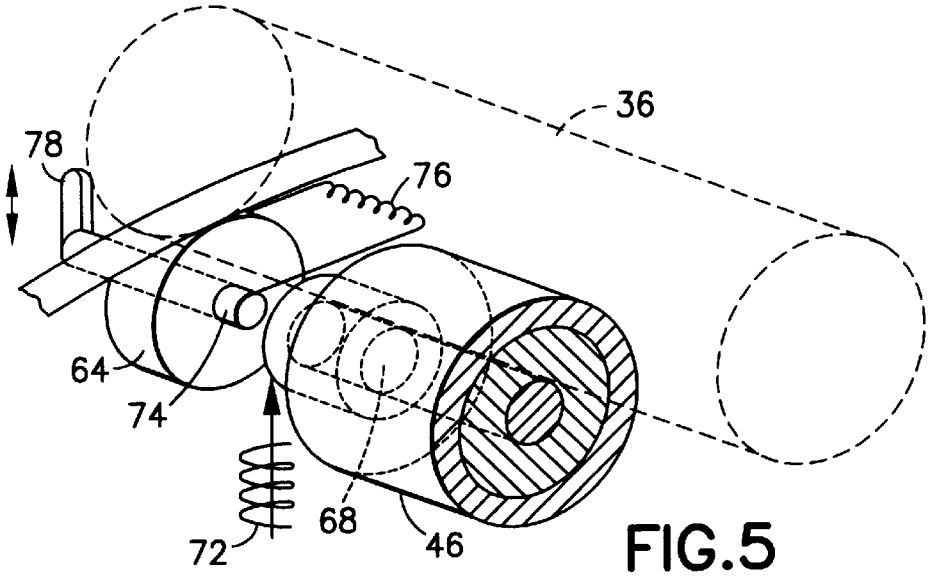
FIG. 5 is a partial perspective view of a second embodiment of an OPC drive band and a pressure roller that transfers drive power to an OPC roller and a transfer roller.

In a second embodiment shown in FIG. 5, pressure roller 64 is mounted on an independent shaft 74 and freely rotates thereon, independent of transfer roller 46. More specifically, shaft 68 on which transfer roller 46 rotates is independent of shaft 74. A spring mechanism 76 (shown schematically) is coupled to shaft 74 and biases pressure roller 64 against OPC drive band 60. Shaft 74 rides in a pair of slots 78 (only one is shown) which allow vertical movement of shaft 74 under control of spring mechanism 76.

Figure 6:
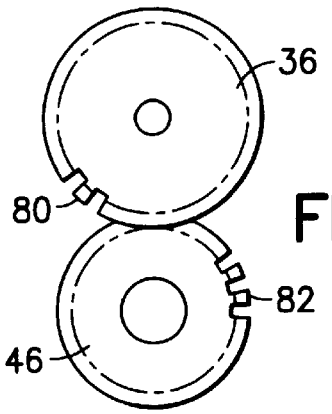
FIG. 6 is a partial perspective view of an opposite end of the OPC drive band and transfer roller shown in FIG. 5, illustrating a gearing arrangement which enables a driving of the transfer roller by the OPC roller.

When the second embodiment of FIG. 5 is employed, driving force is imparted to transfer roller 46 via a gear arrangement positioned at the opposite ends of OPC roller 36 and transfer roller 46. That arrangement is illustrated in FIG. 6 which shows an end view of OPC roller 36 and transfer roller 46, and their respective interlocking gear structures 80 and 82. Gear structures 80 and 82 are positioned in right frame member 52 (see FIG. 2). Accordingly, the movement of OPC drive band 60 imparts rotary motion to OPC roller 36 which, via interaction of gear members 80 and 82 at the opposite ends of the respective rollers, causes transfer roller 46 to be rotated.

Referring back to FIG. 2, a further drive pulley 26 is mounted on drive shaft 56 and imparts rotary motion to media drive band 22. Media drive band 22 rides over a surface 88 (on an inner side of left frame member 54) to a follower pulley 24, shown is FIG. 1, which is tensioned in a rightward direction by spring biased link 91. A plurality of backup rollers 23, shown in FIG. 1, are positioned on the inner side of left frame member 54 and support media drive band 22. A plurality of skew rollers 20 (largely hidden by roller housings 94) are positioned in opposition to a plurality of backup rollers 23 (FIG. 1) and are spring biased thereagainst. Each skew roller 20 is positioned to move a media sheet that is input from the right of FIG. 2, towards a justifying surface 96. A media support insert 100 is positioned between adjacent transfer rollers 46 and acts to provide physical support to a media sheet passing thereover (only one is shown in FIG. 2).

Figure 3:
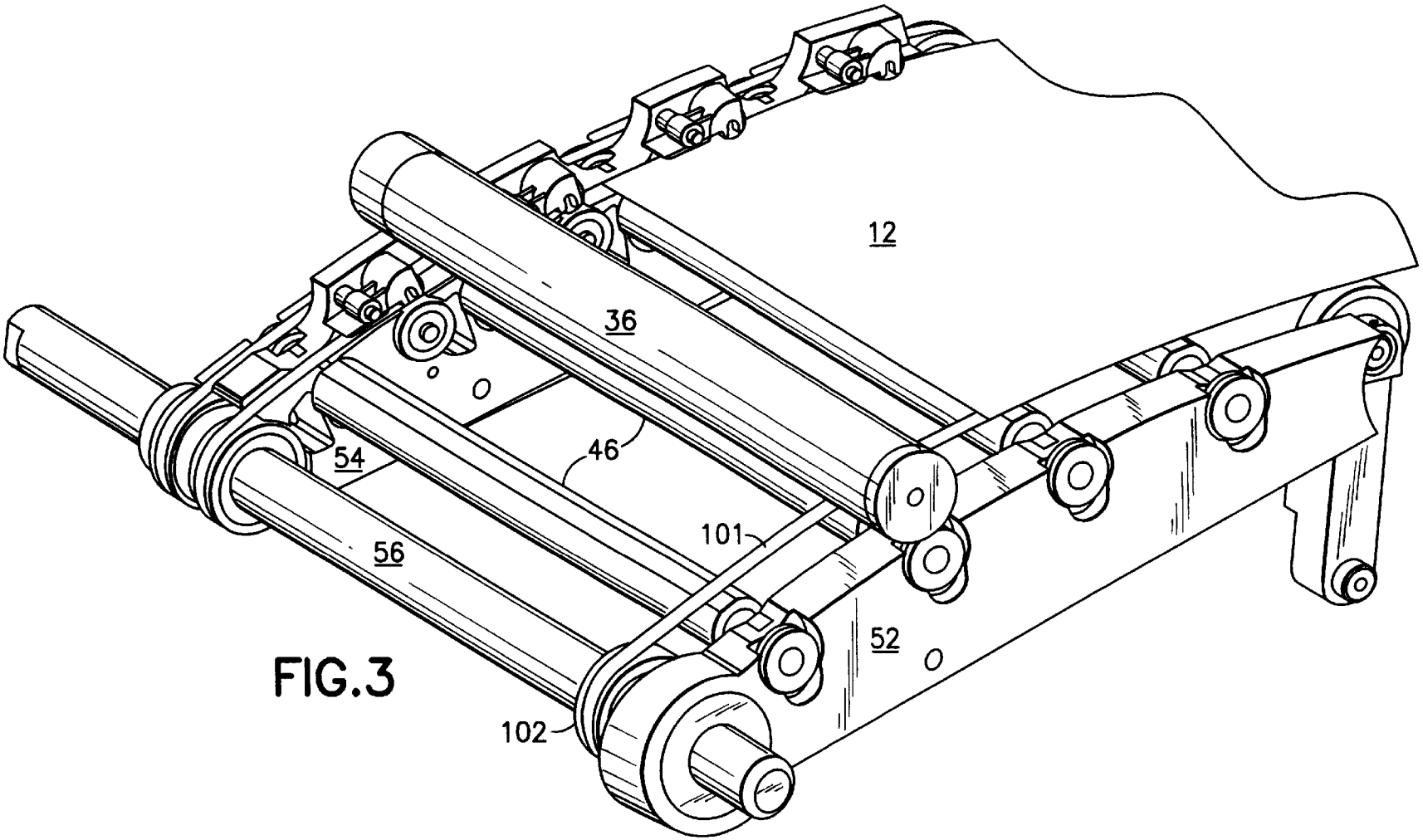
FIG. 3 is a perspective view of the media transport apparatus of FIG. 2, showing a media sheet therein.

Turning to FIG. 3, a media sheet 12 is shown passing through media sheet drive mechanism 50. A counter clockwise rotation of drive shaft 56 causes both OPC drive band 60 and media drive band 22 to move in a leftward direction in FIG. 3. The movement of OPC drive band 60 causes each OPC roller 36 to be driven, in common, in a clockwise direction and each transfer roller 46 to be driven, in common, in a counterclockwise direction. Such driving action provides both a leftward driving force for media sheet 12, as well as a transfer of a toned image from each OPC roller 36 to media sheet 12.

Since OPC drive band 60 provide a common driving force for all OPC rollers and engaging transfer rollers, identical rotational speeds are experienced at points of contact between OPC rollers 36 and media sheet 12 at each developer station. Such identical rotational speeds at each interacting pair of rollers are achieved by virtue of the fact that the driving force is applied to be periphery of each driven roller. This action avoids the color plane registration problems which occur as a result of run-out and diameter variations of such rollers when they are driven by systems which act through their respective central axes.

Examination of FIG. 3 indicates the addition of a second media drive band 101 that is, in turn, driven by drive shaft 56 through pulley 102. Media drive band 101 is optional, as the driving force for media sheet 12 is principally derived from media drive band 86 and the driving force which exists at the nip between each adjoining OPC roller 36 and transfer roller 46.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed:

1. An apparatus for producing color images on a media sheet, comprising:

plural developer stations arranged along a media travel path, each developer station including a photoreceptor roller and a transfer roller, means for toning the photoreceptor roller with one of a plurality of color toners, and means for image-wise exposing said photoreceptor roller to establish image charge states thereon;

OPC band means extending along said media travel path and in driving contact with peripheries of each photoreceptor roller at each of said plural developer stations;

media band means extending along said media travel path and in driving contact with a media sheet passing between the photoreceptor roller and the transfer roller at each of said plural developer stations; and drive means for concurrently driving said OPC band means and media band means to enable said media sheet and each photoreceptor roller to exhibit synchronized speeds of movement at a point of contact therebetween.

2. The apparatus as recited in claim 1, wherein said drive means comprises a common drive shaft that is coupled to both said OPC band means and media band means.

3. The apparatus as recited in claim 2, wherein said media band means comprises at least two drive bands, a first band located on one side of said media travel path and a second band located on an opposite side of said media travel path.

4. The apparatus as recited in claim 1, wherein said OPC band means is drivingly coupled to each transfer roller at each developer station so as to ensure that each photoreceptor roller and associated transfer roller are driven at the same peripheral speed by said OPC band means.

5. The apparatus as recited in claim 4, wherein said driving coupling between said OPC band means and each transfer roller at each developer station comprises a pressure roller that is spring biased to force said OPC band means into driving contact with said photoreceptor roller, said pressure roller mounted on a common shaft with said transfer roller.

6. The apparatus as recited in claim 4, wherein said driving coupling between said OPC band means and each photoreceptor roller at each developer station comprises a pressure roller that is spring biased to force said OPC band means into driving contact with said photoreceptor roller, said photoreceptor roller further including a portion that is in driving contact with said transfer roller so as to impart rotary driving motion to said transfer roller.

7. The apparatus as recited in claim 1, wherein each photoreceptor roller includes a peripheral portion which exhibits a high coefficient of friction and is in contact with said OPC band means.

8. The apparatus as recited in claim 1, further comprising:

a media justification edge positioned along said media travel path; and plural skew roller assemblies positioned along said media band means, for moving an edge of said media sheet being driven by said media band means against said media justification edge.

9. The apparatus as recited in claim 1, wherein said plural developer stations comprise four developer modules, each developer module emplacing a single color plane of subpixels on said media sheet in registration with other color planes of subimages, in a single pass of said media sheet past said developer modules.

10. The apparatus as recited in claim 1, wherein said plural developer stations comprise four developer modules devoted to deposition of black, magenta, cyan and yellow toned color plane images on said media sheet.

* * * * *